US005105742A

United States Patent [19]

Sumner

[11] Patent Number: 5,105,742

[45] Date of Patent: Apr. 21, 1992

[54] FLUID SENSITIVE, POLARITY SENSITIVE SAFETY DETONATOR

[76] Inventor: Cyril R. Sumner, 7102 El Sereno, Houston, Tex. 77083

[21] Appl. No.: 493,969

[22] Filed: Mar. 15, 1990

[51] Int. Cl.[5] ..... F42B 3/00; F42C 15/34

[52] U.S. Cl. ..... 102/312; 102/313; 102/265

[58] Field of Search ..... 102/312, 313, 256, 265

[56] References Cited

U.S. PATENT DOCUMENTS

| | | | |
|---|---|---|---|
| 3,034,437 | 5/1962 | Schermer et al. | 102/265 X |
| 3,858,515 | 1/1975 | Rusbach | 102/56 |
| 3,911,823 | 10/1975 | Murray et al. | 102/86.5 |
| 3,952,658 | 4/1976 | Broyles | 102/40 |
| 4,062,288 | 12/1977 | Millray | 102/39 |
| 4,063,514 | 12/1977 | Hadfied | 102/79 |
| 4,158,334 | 6/1979 | Osburn | 102/16 |
| 4,736,682 | 4/1988 | Roosmann | 102/269 |
| 4,848,235 | 7/1989 | Postler et al. | 102/393 |

*Primary Examiner*—Peter A. Nelson
*Attorney, Agent, or Firm*—Gunn, Lee & Miller

[57] ABSTRACT

A fluid sensitive, polarity sensitive safety detonator system for use in a perforating gun assembly is disclosed. The detonator system is housed within the perforating gun housing and is operatively connected to surface located detonating means. A non-electric detonator is selectively coupled with an electrically fired detonator so that the detonators are not coupled during transit, during arming of the device, during assembly of the device and at all other times. A polarity sensitive circuit selectively arms the detonator assembly and a safety interlock system automatically grounds the detonator assembly upon intrusion of borehole fluids within the peforating gun housing.

28 Claims, 2 Drawing Sheets

FLUID SENSITIVE, POLARITY SENSITIVE SAFETY DETONATOR

BACKGROUND OF THE DISCLOSURE

The present disclosure is directed to a safety detonator intended for use in down hole apparatus, particularly for use in a perforating gun assembly.

A perforating gun assembly normally incorporates an elongate tubular sleeve or body which internally encloses multiple shaped charges. Upon detonation, the shaped changes form perforations extending outwardly radially of the well borehole and pass through the surrounding housing or assembly, and additionally form deep penetrating fluid flow passages through the surrounding casing, cement and into the adjacent formations. To assure proper detonation of the shaped charges, a detonator assembly is incorporated in the perforating gun assembly. The detonator assembly is connected to the surface via an electrical conductor, and when properly detonated, it provides detonation in a predetermined timed sequence to a detonation cord which connects with each of the shaped charges. The detonator assembly is therefore the key safety device in operation of the equipment.

Heretofore, detonator assemblies have been constructed with an electrically triggered detonator which is coupled through a passage or open space to a non-electric detonator adjacent to a detonating cord. On application of an electrical signal the electric detonator detonates, thereby, producing a shock wave or impulse which is transferred across the open space to the non-electric detonator. The non-electric detonator in turn is detonated, coupling the charge from the original electrical impulse into the detonating cord and to the shaped charges so that each charge of the perforating gun assembly is sequentially detonated. The detonator assembly has been intended as a safety device. There is a balance in the geometry of the detonating apparatus because the spacing between the electrically fired detonator and the non-electric detonator is crucial to safety.

The two critical dimensions of the spacing or passage, known in the industry as the "fire channel", coupling the electrically fired detonator to the non-electric detonator is the diameter (D) and the length (L). If D is too small, it acts as a choke and not enough force is transmitted through the fire channel to insure proper detonation of the non-electric detonator. If the distance L is too long, the same problem exists, i.e. not enough force is transmitted through the fire channel to insure proper detonation of the non-electric detonator. This often results in a low order detonation whether or not there is fluid in the fire channel. If the distance L is shortened to overcome the above described detonation problem, when dry, it increases the percentage of "fires" when the fire channel is filled with fluid, which is also undesirable.

Generally, the fire channel between the electrically fired detonator and the non-electric detonator is kept clear of well fluid. However, an opening is typically drilled in the detonator assembly which intentionally delivers well fluid into the fire channel. If the perforating gun assembly is exposed to well fluids, it is important that it not fire and fluid introduced in this region normally prevents firing. The length L must be sufficiently long that fluid in the tool dampens, even prevents transfer of the detonation shock wave. On the other hand, the components must be close enough to assure that the electrical impulse does in fact detonate the electrically fired detonator and make the necessary transfer to the non-electric detonator. Accordingly, the length L should not be too long or too short. If L is too long, misfiring will occur because the shock wave is attenuated as it travels through the long distance. If the length L is too short, then the safety system which responds to well fluids around the perforating gun assembly will not operate. As the length L is reduced, firing may still nevertheless occur because the well fluids do not totally prevent shock transfer from the electrically fired detonator to the non-electric detonator. Accordingly, this suggest that the length L be increased.

Control of the length L is thus difficult, being almost a balance of terror, where misfires occur because the shock wave does not get to the non-electrical detonator where L is too great, and unintended firings occur where L is too short and the perforating gun assembly is submerged in well fluids.

The present disclosure sets out a system which overcomes these risks and provides a much safer detonator assembly. The detonator assembly of the present disclosure avoids the dimensional sensitivity to the measure L as described above. Rather, the detonator assembly of the present disclosure couples the electrically fired detonator to the non-electric detonator through an open area which is in the form of a passage. The passage is somewhat short, sufficiently short to assure that coupling does occur so that transfer of the explosive shock wave assures detonation. The passage connecting the electrically fired detonator to the non-electric detonator is an open passage which is plugged by a solenoid operated plug. Thus detonation transfer into the passage is intentionally removed. Accordingly, the electrically fired detonator is not coupled with the non-electric detonator during transit, during arming of the device, during assemlby of the perforating gun, and at all other times. It is kept safe because there is isolation between the detonators.

The perforating gun assembly is a dangerous device to be handling. One of the dangers arises from stray electrical currents. The electrical currents typically arise in the context of handling such a device. It is normally loaded on a service vehicle such as a truck which carries a number of other devices and logging tools. It is not uncommon to load this device in the assembled state on a truck along with other logging devices. The truck normally is equipped with a reel or drum of electrical cable which is wrapped in a special fashion and which is otherwise described as an armored logging cable. The logging cable may support a great variety of electrical or nuclear logging devices which are carried on the same truck. All these devices connect with a variety of power supplies through the logging cable. The service vehicle normally connects the logging cable with one or more logging tools which respond to all types of electrical currents including high frequency AC, low frequency AC, and direct current, both positive and negative in polarity. The existence of electrical current generating equipment on such a truck runs the risk of creating stray currents, both in transit and at the site. Stray currents are a significant problem for perforating gun assemblies whether equipped with conventional detonators known heretofore or the high energy type detonators which are currently popular. High energy detonators require substantially more electrical power for operation. Accordingly, the truck mounted power supplies have large outputs so that high energy detonators can be triggered. The present apparatus takes advantage of a sequence of operations including polarity reversals to assure that the present device is fired intentionally, and does not fire in accidental circumstances. In other words, the device both in a stored situation or in a perforating gun assembly prior to intentional firing has a polarity sensitive circuit which assures that firing occurs only on the right voltage application to the device. Moreover, it includes means rejecting AC currents and hence does not fire when an AC current is applied to it.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
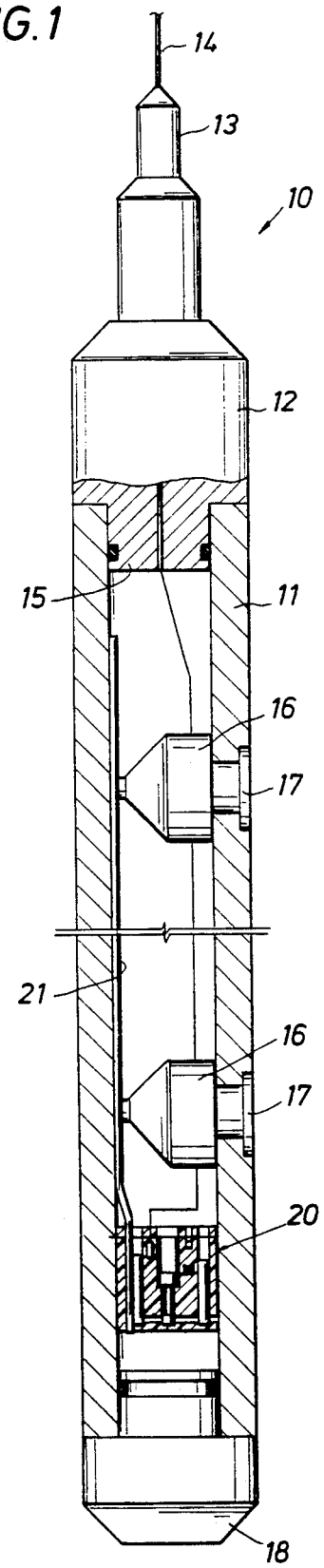
FIG. 1 shows a perforating gun assembly incorporating multiple shaped charges and is the device which is triggered into operation to form perforations as a result of proper and safe detonation by the detonator assembly of the present disclosure.

Attention is now directed to FIG. 1 of the drawings which shows a perforating gun assembly utilizing the detonator assembly of the present disclosure. The perforating gun assembly 10 includes an elongate cylindrical sleeve or housing 11 which is threaded to or attached to a sub 12. The sub connects with a neck 13 which includes a conventional fishing neck of standard construction, and which axially aligns with an armored logging cale 14. A logging cable encloses one or more conductors for electrical communication from the surface. At the surface, a voltage source to be described is operated to provide a firing signal on the conductor in the cable 14.

The device 10 includes a closure member 15 which plugs the upper end of the sleeve or housing 11 making up the elongate housing. The housing 11 can be short for enclosing only a single shaped charge, or it can be quite long to enclose many similarly shaped charges. They are installed in similar fashion repetitively along the length of the structure. The shaped charges 16 are typically positioned opposite scallops 17 at the exterior which have a reduced thickness to show the location of the shaped charges and to enable the plume of fire generated upon detonation to be directed more readily through the thinner regions at the scallops 17. The detonator assembly 20 of the present disclosure is installed at the lower end of the cylindrical housing 11. The lower end of the housing 11 is closed by a bull plug 18 located at the bottom of the housing. The perforating gun assembly 10 is sealed so that the interior chamber of the housing 11 excludes well fluids. A dry atmosphere is maintained around the shaped charges 16, detonator assembly 20 and the detonating cord 21.

The detonator assembly 20 is located at the bottom of the housing 11 and is therefore exposed to any fluid which might enter the perforating gun assembly 10 through an inadvertent leak. Recall that the perforating gun assembly 10 is preferably dry on the interior. Should a leak occur, any fluid will accumulate at the bottom end of the housing 11, and the fluid at the bottom end will prevent firing. This safety feature is incorporated in the detonator assembly 20 of the present disclosure.

Figure 2:
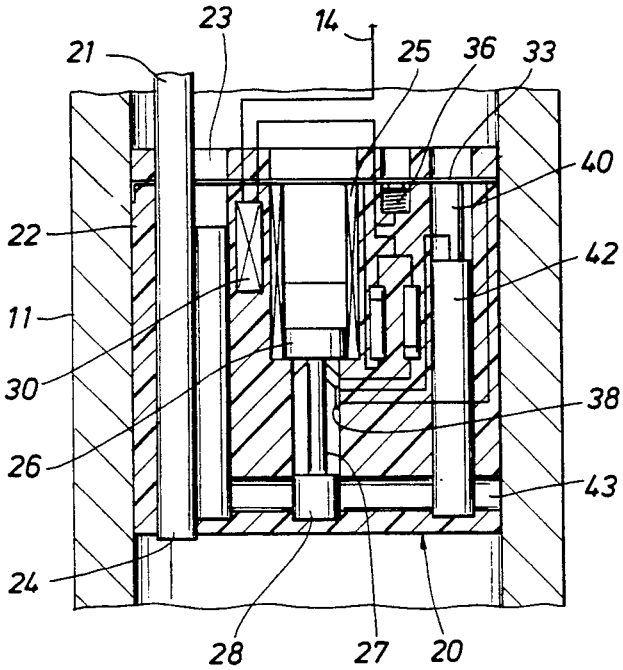
FIG. 2 is an enlarged view showing the detonator assembly of the present disclosure including details of construction thereof.

Going now to FIG. 2 of the drawings, the detonator assembly 20 is shown in greater detail. It is formed of a plastic shell or housing 22 with a passage drilled therethrough to enable the detonating cord 21 to be positioned in the passage. In any event, it extends to the other shaped charges for detonation. It is immediately adjacent to a chamber 23 for receiving a non-electric detonator 24. The detonator 24 is a material which is relatively difficult to detonate. It is preferably made of explosive materials which are relatively insensitive. Accordingly, the detonator 24 is installed in the chamber 23 immediately adjacent to the detonating cord 21, and its mode of detonation will be set forth in greater detail as will be detailed herein.

The housing 22 has a coil 25 cast therein with conductors extending to the exterior of the coil 25 for connection as will be discussed. This is immediately adjacent to a metal plunger 26 connecting with a stem 27 which connects to a plug 28. These components move together as a unit. They are moved into the coil 25 when electrical current is applied to the coil 25 and locked in the armed position by spring latch 29 as shown in FIG. 3.

Figure 3:
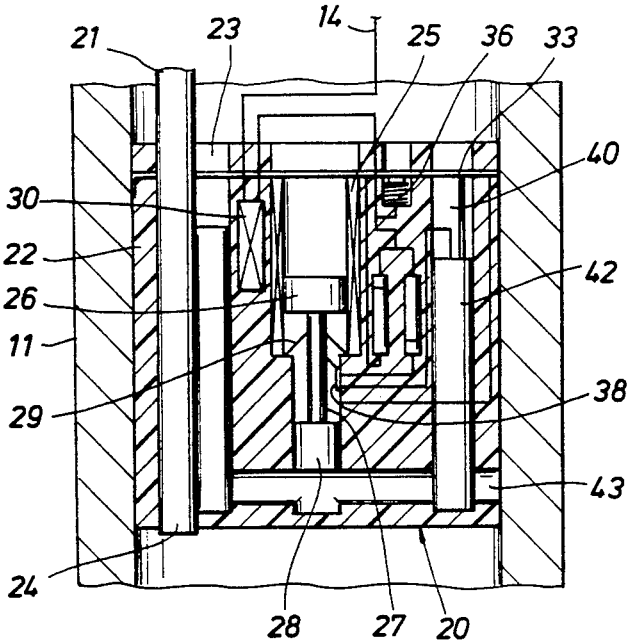
FIG. 3 is an enlarged view of the detonator assembly showing the solenoid plug retracted to open fire channel of the detonator assembly.
Figure 4:
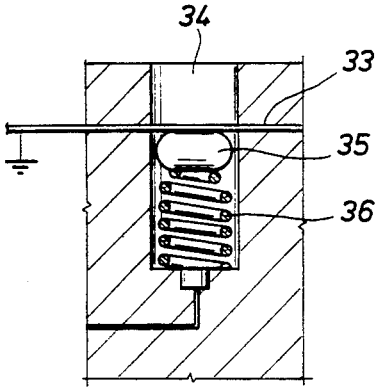
FIG. 4 is an enlarged view of the wet switch safety feature of the detonator assembly of the present disclosure.
Figure 5:
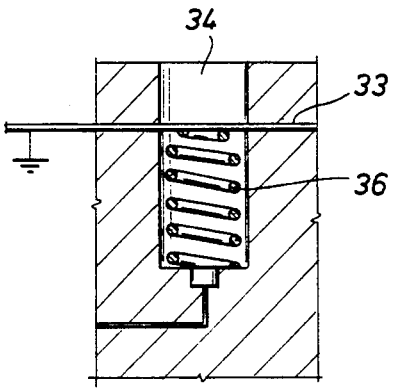
FIG. 5 is an enlarged view of the wet switch safety feature of the present disclosure showing cable conductor grounding rendering the detonator assembly inoperable.

Referring now to FIG. 3, another component shown in the detonator assembly 20 is a coil 30 which is embedded in the structure of the device and which is connected by suitable wires with the circuitry. Additional circuitry that is embedded in the system includes the diodes 31 and 32. Their connections will also be described. A ground strap 33 extends through a transverse opening 34 which is formed in the housing 22, and a solid pellet 35 is positioned against the ground strap 33, as more clearly shown in FIG. 4. A coil spring 36 bears against the pellet 35. The coil spring 36 is made of metal. It is connected in circuitry as will be shown in the schematic discussed below. The coil spring 36 forces the pellet 35 against the ground strap 33.

The pellet 35 is made of insulative material. There is no current conducted to the ground strap 33 through the pellet 35 as long as it is in place. It is interposed between the coil spring 36 and the ground strap 33. It is preferably made of a material which dissolves readily in the fluid anticipated in the borehole. For instance, if conventional drilling fluid is use, it is ordinarily made by mixing various barites with water. To this end, the pellet 35 is preferably a material which is soluble in water. As an example, various and sundry salts can be used for this purpose. When exposed to water, the pellet 35 is dissolved, thereby permitting the coil spring 36 to expand and contact the ground strap 33. When this occurs, shorting to ground occurs which is important in operation of the detonator assembly 20.

In effect, the coil spring 36 is connected to operate as a controllable switch which is in a normally open condition. Separately, another switch member 38 is included. This switch is affixed to the stem 27 just mentioned and moves from a first switched position to a second position as will be detailed.

The reference numeral 40 identifies a chamber incorporated for receiving an electrically fired detonator therein. The electrically fired detonator is normally constructed as an elongate cylindrical member and in this instance, is identified at 42. The detonator 42 is electrically fired. It forms a shock wave which travels along a transverse passage 43. The passage 43 extends from the electrically fired detonator 42 to the non-electrical detonator 24 to couple the shock wave between the two explosives. The shock wave is propagated along the passage 43. The passage 43 is controlled so that the length of the passage 43 between the detonators 24 and 42 is controllably short. This assures that the shock wave is propagated along the passage 43 and impinges on the detonator 24, causing its detonation. Prior to arming the detonator assembly 20, the passage 43 is plugged by the plug 28 previously mentioned. The plug 28 is sized in conjuction with the passage diameter so that substantially the entire passage 43 is plugged. The plug 28 is sufficiently large that it blocks access to the non-electric detonator 24 when the plug 28 is in the position shown in FIG. 2 of the drawings. When the plug 28 is raised, the passage 43 is cleared for easy signal transmission.

Figure 6:
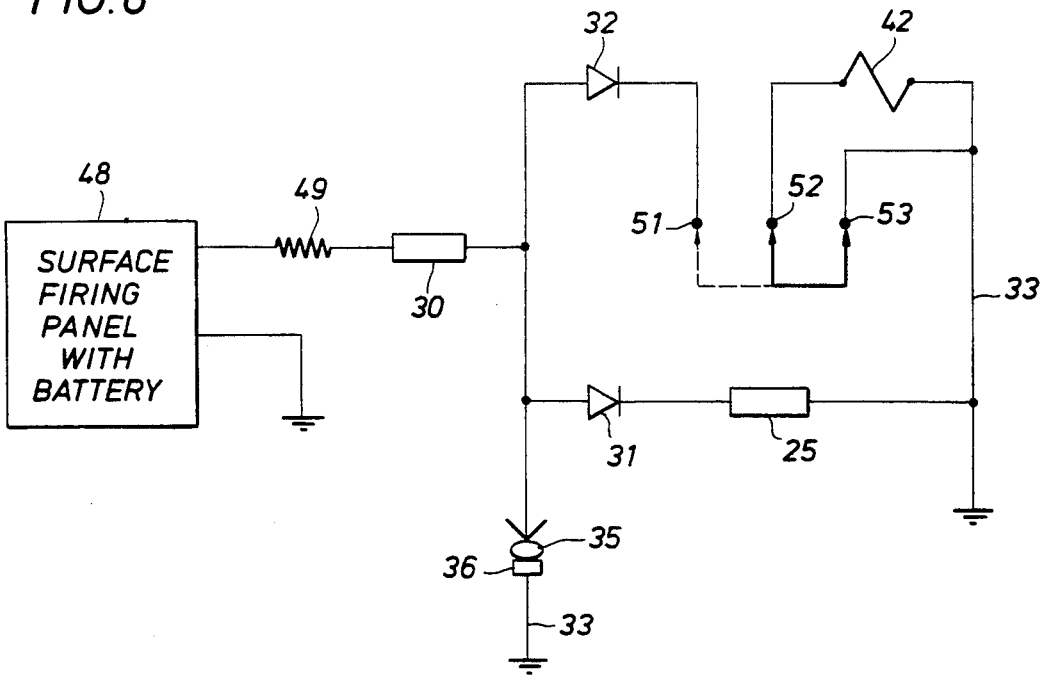
FIG. 6 is a schematic wiring diagram of the detonator assembly showing circuit connections for safe operation.

The passage 43 does not include any means of access for well fluids. It is not necessary however, that well fluids enter the passage 43 to provide the safety interlock in the event the perforating gun is submerged and leakage occurs within the perforating gun assembly 10 as discussed earlier. Rather, another system is included to provide an interlock for protection in this regard. Going now to FIG. 6 of the drawings, the numeral 48 identifies a surface firing panel which provides appropriate electrical power to the conductor 49. The conductor 49 is in the armored cable 14 shown in FIG. 1. This electrical conductor extends to the perforating gun assemlby 10 and connects with the electrically fired detonator 42 shown in FIG. 2 and comprises a portion of the circuitry shown in schematic form at FIG. 6. The cable 14 thus supports the conductor 49 which is input to the coil 30 previously illustrated in FIG. 2. The coil 30 is arrange serially. It has sufficient inductance to block current flow for any AC input. The diode is serially connected with the coil 25 to operate the solenoid plug 28. In addition, the diode 32 is connected with the contact 51 which is at the left hand end or nearer the plunger 26. The contacts 52 and 53 are likewise included. The moveable switch member 38 supported by the stem 27 makes contact across two of the three terminals as shown in the drawing. On movement, it makes contact with another pair. In the off or running position shown in FIG. 2, the switch member 38 spans contacts 52 and 53; it spans the contacts 51 and 52 when moved to the armed postion shown in FIG. 3.

The contact 52 connects serially through the fired detonator 42. It also then connects to ground which is the ground strap 33 previously mentioned. The group strap 33 connects to ground through the coil spring 36. Recall that the coil spring 36 is held in the normally open condition by the pellet 35. The pellet 35 is included to block the switch normally open so that no current flows to ground.

Operation of the system of the present disclosure is now considered. Assume that the surface firing panel 48 includes a battery. Assume further that unwanted or stray AC currents are detected by the conductors 49 in the cable 14. In that instance, any AC currents to the equipment in the perforating gun assembly 10 are blocked by the high frequency coil 30. It preferably has a relatively high inductance to block the current flow. It preferably passes only DC or very low frequency AC current, substantially lower than 60 cycles. Ideally, the coil 30 is relatively high in inductance to serve as a barrier to AC current flow into the perforating gun assembly 10. Assume that a battery, included at the surface firing panel 48, is ready for use. In that instance, the following sequence of operations and events must occur. First, a negative current must be applied to the cable 14. The negative current can flow only through the diode 31. However, even this will not happen if the perforating gun assembly 10 is wet, i.e., meaning that the perforating gun has been submerged in drilling fluid which has leaked into the structure whereupon grounding will occur. For running and arming, it is assumed that the pellet 35 remains intact and is not dissolved as would occur on exposure to borehole fluids.

The first step is therefore to apply a negative pulse of substantial current flow. The duration should be sufficient to operate the solenoid coil 25 at a substantial current level. For instance, a current flow of 500 ma is first applied for about one half to one second. Application of current for a longer duration does not make any difference. When this occurs, the current is permitted to flow through the solenoid coil 25 and triggers the mechanical change which arms the device. Prior to movement of the plunger 26 and connecting stem 27, the device was not armed because the connective switch member 38 shorted the electrically fired detonator 42 to ground. Therefore, current flow through the solenoid coil 25 provides arming of the device by moving the switch member 38 to connect across the terminals 51 and 52. After that has been accomplished, the current is stopped and the perforating gun assembly is then armed for operation. Next, a current of about 500 ma is again applied. In this instance, the current must be positive so that the diode 32 will pass the current flow. Accordingly, a positive pulse applied first accomplishes nothing because it passes the diode 32 but cannot flow to any part of the circuitry and is blocked by the diode 31. Therefore, the first pulse must be a negative pulse of DC current. AC current will not pass the the coil 30 while a negative DC pulse will pass the diode 31 and provide a magnetic field from the solenoid coil 25 which moves the plunger 26 thereby clearing the passage 43. Thereafter, a positive current pulse is again applied. This current pulse is passed by the diode 32 and flows through the terminal 51, the switch member 38, the terminal 52 and flows through the detonator 42. This is sufficient to detonate the explosive. At this juncture, the explosive shock wave travels through the passage 43 and impinges on the detonator 24, detonating the detonator 24 and in turn detonating the detonator cord 21.

It is understood that the polarity used in the preferred embodiment is for illustration purposes only. It can readily be seen that by reversing diodes 31 and 32, and reversing the current polarity sequence, the same result is obtained.

The system described above is insensitive to AC, and indeed rejects AC currents. It will not be triggered by AC signals. This is true both in the running position and the armed position. It is also true in the stored condition. Separately, it is responsive to a sequence of DC current pulses. The sequence is a negative current pulse first and a positive current pulse thereafter. The negative current pulse is necessary to operate the solenoid coil 25 which in turn clears the passage 43 to thereby arm the detonator. In addition, the negative current pulse moves the switch member 38 to bridge the contacts 51 and 52.

In addition to the above safe guards, a safety interlock is incorporated whereby the pellet 35 responds to unintended leaks of borehole fluid. This is protective of firing when a leak has occured. Accordingly, if the detonator assembly 20 is dry, the wet switch formed by the spring 36 and the ground strap 33 is held open. In the storage condition and the running position, the wet switch is normally open. If it closes at any time, it completely grounds all input currents to the detonator. Closure of the wet switch is thus occasioned by dissolving the pellet 35, and the spring 36 mechanically assures closure to the ground strap 33.

While the foregoing is directed to the preferred embodiments of the present invention, other and further embodiments of the invention may be devised without departing from the basic scope thereof, and the scope thereof is determined by the claims which follow.

What is claimed is:

1. A perforating gun assembly for use in forming fluid flow passages in a subterranean formation about a wellbore, comprising:

a) a housing suspended on a cable down a wellbore opposite a subterranean formation of interest, said housing defining a sealed interior chamber;

b) at least one shaped charge carried within said housing, wherein upon detonation said shaped charge penetrates the subterranean formation forming fluid flow passages in the subterranean formation;

c) a detonator assembly carried within said housing for detonating said shaped charge;

d) surface located means for detonating said detonator assembly for initiating detonation of said shaped charge; and e) circuit means insensitive to spurrious AC currents and responsive only to a sequence of DC currents for selectively arming said detonator assembly.

2. The apparatus of claim 1 wherein said detonator assembly comprises a detonator housing operatively connected to said surface located detonating means, said detonator housing including a passage extending therethrough for receiving a detonating cord, said detonating cord extending to other shaped charges within said housing for sequential detonation.

3. The apparatus of claim 2 wherein said detonator assembly includes an electrically fired detonator and a non-electric detonator housed within said detonator housing, said electrically fired detonator coupled to said non-electric detonator by a passage extending therebetween.

4. The apparatus of claim 3 wherein said non-electric detonator comprises relatively insensitive explosive material housed within a chamber in said detonator housing adjacent to said detonating cord.

5. The apparatus of claim 3 wherein said detonator assembly includes first coil means for moving plug means for opening and closing said passage extending between said electrically fired detonator and said non-electric detonator.

6. The apparatus of claim 5 wherein said plug means comprises a unitary reciprocal plug member formed by a metal plunger and a plug member separated by a stem.

7. The apparatus of claim 5 wherein said detonator assembly includes second coil means operatively connected to said circuit means for blocking AC current transmission to said electrically fired detonator.

8. The apparatus of claim 5 wherein said detonator assembly includes switch means carried by said plug means for selectively arming said perforating gun.

9. The apparatus of claim 2 wherein said detonator assembly includes a ground strap extending through a transverse opening formed in said detonator housing, said ground strap cooperating with safety means for grounding all input currents to said detonator assembly.

10. The apparatus of claim 9 wherein said safety means comprises spring means bearing against a pellet normally separating said spring means from said ground strap.

11. The apparatus of claim 3 wherein said detonator assembly includes diode means for selectively passing positive or negative current for completing said circuit means.

12. The apparatus of claim 1 wherein said circuit means includes terminal means selectively engagable by a switch member for arming and disarming said detonator assembly.

13. A detonator assembly for detonating a perforating gun, comprising:

a) a detonator housing operatively connected to surface located detonating means, said detonator housing including a passage extending therethrough for receiving a detonating cord, said detonating cord extending to other shaped charges for sequential detonation;

b) an electrically fired detonator housed within a first chamber located within said detonator housing;

c) a non-electric detonator housed within a second chamber formed in said detonator housing; and d) a passage extending between said first and second chambers coupling said electrically fired detonator to said non-electric detonator.

14. The apparatus of claim 13 including means for selectively blocking said passage for preventing detonation of said detonator assembly.

15. The apparatus of claim 13 wherein said non-electric detonator comprises relatively insensitive explosive material housed within said second chamber in said detonator housing adjacent to said detonating cord.

16. The apparatus of claim 13 wherein said detonator assembly includes first coil means for moving plug means for opening and closing said passage extending between said electrically fired detonator and said non-electric detonator.

17. The apparatus of claim 16 wherein said detonator assembly includes second coil means operatively connected to said circuit means for blocking AC current transmission to said electrically fired detonator.

18. The apparatus of claim 16 wherein said detonator assembly includes switch means carried by said plug means for selectively arming said perforating gun.

19. The apparatus of claim 13 wherein said detonator assembly includes a ground strap extending through a transverse opening formed in said detonator housing, said ground strap cooperating with safety means for grounding all input currents to said detonator assembly.

20. The apparatus of claim 19 wherein said safety means comprises spring means bearing against a pellet normally separating said spring means from said ground strap.

21. The apparatus of claim 13 wherein said detonator assembly includes diode means for selectively passing positive or negative current for completing said circuit means.

22. The apparatus of claim 13 wherein said circuit means includes terminal means selectively engagable by a switch member for arming and disarming said detonator assembly.

23. A method of perforating a subterranean formation, comprising the steps of:

a) connecting a perforating gun to surface located detonating means and suspending said perforating gun in a wellbore opposite a subterranean formation of interest;

b) applying a negative DC current pulse to detonator means carried within the perforating gun for arming the perforating gun; and c) subsequently applying a positive DC current pulse to said detonator assembly for detonating the perforating gun.

24. The method of claim 23 including the step of retracting plug means from a passage connecting an electrically fired detonator to a non-electric detonator housed within a detonator assembly enabling an explosive shock wave upon detonation of said electrically fired detonator to travel through said passage and detonate said non-electric detonator for sequentially detonating shaped charges carried by said perforating gun for forming perforations in the subterranean formation.

25. The method of claim 24 including the step of disarming said detonator assembly upon intrusion of borehole fluids within the perforating gun housing.

26. The method of claim 25 wherein said disarming step includes the step of providing soluble pellet means which are dissolved by borehole fluids for mechanically grounding said detonator assembly.

27. A perforating gun assembly for use in forming fluid flow passages in a subterranean formation about a wellbore, comprising:

a) a housing suspended on a cable down a wellbore opposite a subterranean formation of interest, said housing defining a sealed interior chamber;

b) at least one shaped charge carried within said housing, wherein upon detonation said shaped charge penetrates the subterranean formation forming fluid flow passages in the subterranean formation;

c) a detonator assembly carried within said housing for detonating said shaped charge;

d) surface located means for detonating said detonator assembly for initiating detonation of said shaped charge;

e) circuit means for selectively arming said detonator assembly; and f) safety means for grounding all input currents to said detonator assembly said safety means comprising a spring bearing against a soluble pellet normally separating said spring from ground means for disarming said detonator assembly upon intrusion of borehole fluids within the perforating gun housing.

28. A detonator assembly for detonating a perforating gun, comprising:

a) a detonator housing operatively connected to surface located control means, said detonator housing including a passage extending therethrough for receiving a detonating cord, said detonating cord extending to shaped charges connected for sequential detonation;

b) detonator means for sequentially detonating said shaped charges; and c) safety means for grounding all input currents to said detonator assembly, said safety means comprising a spring bearing against a soluble pellet normally separating said spring from ground means for disarming said detonator assembly upon intrusion of borehole fluids within said detonator housing.

* * * * *